US009721544B2

(12) United States Patent
D'Addario

(10) Patent No.: US 9,721,544 B2
(45) Date of Patent: Aug. 1, 2017

(54) METAL-PLATED MUSIC STRING

(71) Applicant: D'Addario & Company, Inc., Farmingdale, NY (US)

(72) Inventor: James D'Addario, Old Westbury, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 4 days.

(21) Appl. No.: 15/220,742

(22) Filed: Jul. 27, 2016

(65) Prior Publication Data

US 2017/0032767 A1 Feb. 2, 2017

Related U.S. Application Data

(60) Provisional application No. 62/197,142, filed on Jul. 27, 2015.

(51) Int. Cl.

| | |
|---|---|
| ***C25D 3/00*** | (2006.01) |
| ***G10D 3/10*** | (2006.01) |
| ***C25D 7/06*** | (2006.01) |
| *C25D 3/12* | (2006.01) |
| *C25D 3/30* | (2006.01) |
| *C25D 3/56* | (2006.01) |
| *C25D 3/60* | (2006.01) |

(52) U.S. Cl.

CPC ..... *G10D 3/10* (2013.01); *C25D 7/0607* (2013.01); *C25D 3/12* (2013.01); *C25D 3/30* (2013.01); *C25D 3/562* (2013.01); *C25D 3/60* (2013.01)

(58) Field of Classification Search

CPC G10D 3/10; G10D 3/143; G10D 1/00; G10D 1/005; D07B 2801/22; D07B 2205/10; D07B 2205/2046; D07B 2205/3007; D07B 1/02; G10C 3/08; C22C 45/04; C22C 38/42; Y10T 428/2933; Y10T 29/49574

USPC ..... 84/297 R, 297 S, 197

See application file for complete search history.

(56) References Cited

U.S. PATENT DOCUMENTS

| | | | | |
|---|---|---|---|---|
| 4,333,379 | A | 6/1982 | Meinel et al. | |
| 5,408,911 | A | 4/1995 | Weiss et al. | |
| 7,476,791 | B2 | 1/2009 | Parker | |
| 2011/0219933 | A1* | 9/2011 | Klanner | G10D 3/10 84/297 S |
| 2014/0041506 | A1* | 2/2014 | Jones | G10D 3/10 84/297 S |
| 2014/0150626 | A1 | 6/2014 | Jolk et al. | |

* cited by examiner

*Primary Examiner* — Kimberly Lockett

(74) *Attorney, Agent, or Firm* — Alix, Yale & Ristas, LLP

(57) ABSTRACT

A music string for a fretted instrument with extended life of initial tonal characteristics has a central core wire having a wrapped wire wound around it. The wrapped wire is coated with a metal or metal alloy. The metal coating may be nickel or tin or alloys of nickel or tin. The coating may be applied on the wrapped wire by a process of electroplating.

19 Claims, 3 Drawing Sheets

METAL-PLATED MUSIC STRING

CROSS-REFERENCE TO RELATED APPLICATION

This application claims the benefit of U.S. Provisional Application No. 62/197,142, filed Jul. 27, 2015 for "Nickel-Plated Phosphor Bronze Music String", the disclosure of which is incorporated herein by reference in its entirety.

BACKGROUND

Many fretted instruments (for example guitars, mandolins, banjos, and the like) are manufactured to be fitted with hard tempered steel core music strings. A high temper steel alloy, such as high-carbon steel, is usually utilized for the higher pitched or "unwound", "plain" strings. The lower pitched strings commonly utilize a similar material as a core, with softer, more ductile material wire as a winding or wrap.

Over the years, string makers have experimented with a wide variety of alloys for the winding wire. Different alloys drawn to different tempers can produce tonal differences that are discernable to experienced musicians. The most popular and believed to be best-sounding strings are wound with a copper based, bronze alloy. Musicians have widely acclaimed the tone of phosphor bronze, 85-15 bronze, 90-10 bronze, and aluminum bronze, or 80-20 brass.

A conventional new copper based alloy string will have what musicians consider a bright, crisp, fresh tone. These are common descriptors of a string that produces a higher amplitude output when played; typically, the higher the amplitude, the "crisper" the tone. Within a matter of hours, the fresh tone of a new copper based alloy string will begin roll off. Depending upon a variety of conditions, such as the climatic conditions, the body chemistry of the musician, and playing style and frequency, a string could lose its crispness or go "dead" very quickly, or in some cases retain its desired tonal qualities for two to four weeks.

Copper based alloys, left unprotected and exposed to ambient air, begin to oxidize quickly. The added effects of moisture caused by human perspiration speed the oxidation process, further causing the string to lose its brilliance.

An effective solution known in the art for delaying oxidation and loss of freshness is to coat the copper based winding wire or the entire wound string with a polymer material. Winding wires are often coated with urethane, enamel, epoxy or other suitable polymeric material. Finished wound strings coated with polytetrafluoroethylene (PTFE) or other polymers provide effective protection to degradation due to oxidation of copper. Both solutions improve how long the new string will retain its original tonal characteristics, although the original tonal sound of a polymer coated string is dampened relative to a new uncoated string.

Unfortunately, the introduction of any flexible, polymeric material such as those described above creates acoustical damping that diminishes the crispness in tone of the new string. The coating, whether on the winding wire or the finished wound strings, will reduce the output of the upper partial harmonics. It would be useful to have a musical instrument string that exhibits crisp tones comparable to an uncoated string, while retaining the original tonal crispness for a longer duration, comparable to a polymer coated string.

SUMMARY

A string for a musical instrument includes a core wire with a winding wire wrapped around it. The winding wire has a central strand of metal alloy with a coating adhered to the central strand. The coating comprises one or more of nickel, a nickel alloy, tin and a tin alloy.

In another embodiment, a musical instrument string comprises a core metal wire, a central strand of a winding wire and a metal coating plated on the exterior of the central strand. The metal coating is nickel, a nickel alloy, tin or tin alloy. The central strand is wrapped around the core metal wire.

In yet another embodiment, a musical instrument string includes a core metal wire with a coated winding wire wrapped around it. The winding wire has a central strand of copper or steel and a coating of nickel, a nickel alloy, tin or a tin alloy adhered to the central strand. The metal coating is coated on the winding wire via electroplating and constitutes approximately 1-10% by weight of the winding wire.

BRIEF DESCRIPTION OF THE DRAWINGS

Aspects of the preferred embodiment will be described in reference to the Drawing, where like numerals reflect like elements.

DETAILED DESCRIPTION

The disclosed embodiments are directed to protecting metal alloy winding wire (wrap wire), which may be for example steel or a copper-containing alloy such as bronze or brass, with a thin metallic coating, particularly a thin coating of nickel or tin, or alloys thereof.

Figure 1:
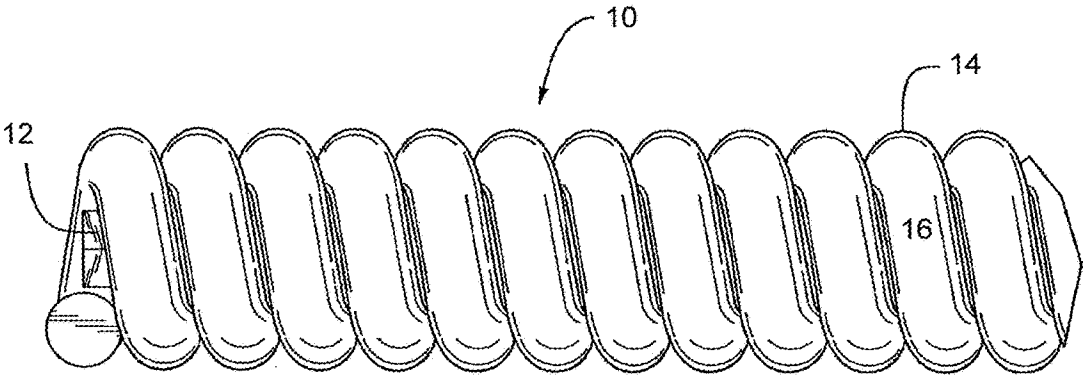
FIG. 1 shows a representative instrument string as disclosed herein.
Figure 2:
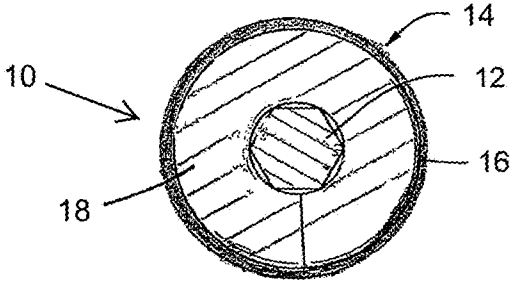
FIG. 2 is a cross-sectional view of the representative string of FIG. 1.
Figure 3:
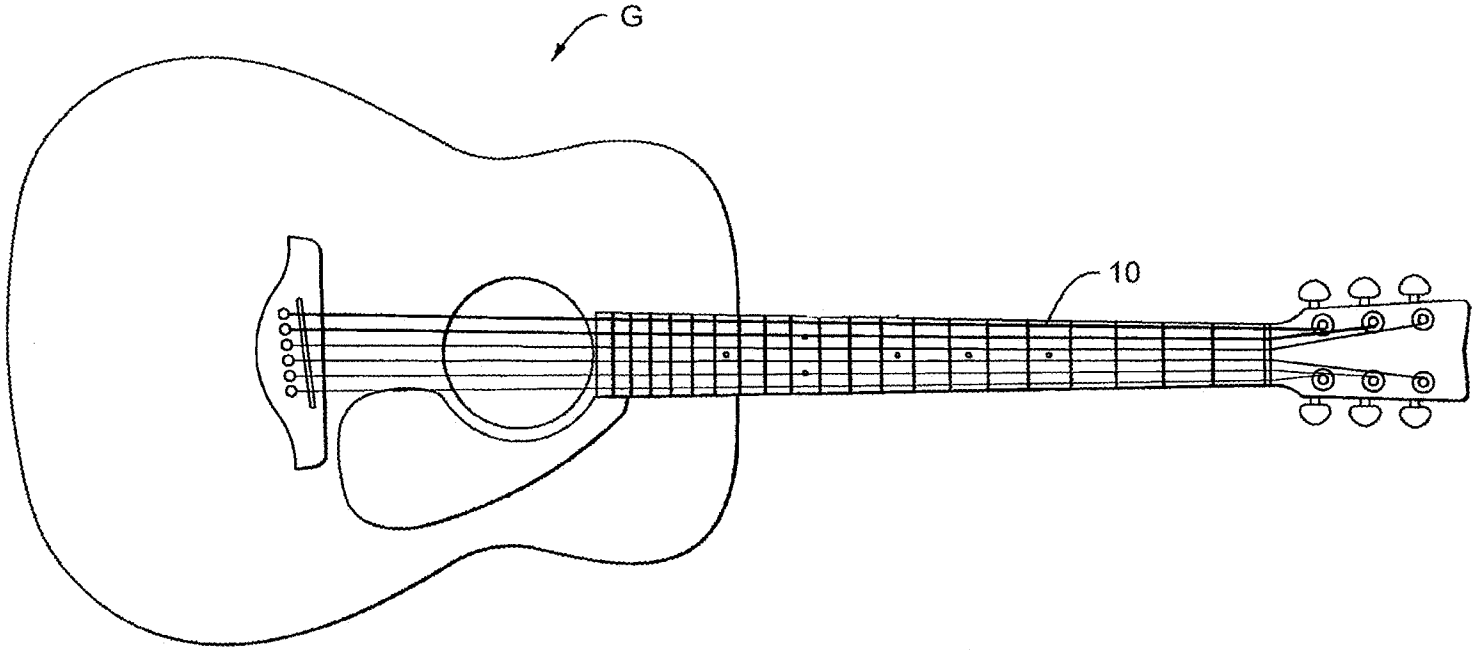
FIG. 3 shows an acoustic guitar with the string of FIG. 1 attached.

FIGS. 1 and 2 show an inventive wound string 10 having a central core wire 12 and a coated winding wire 14. FIG. 3 shows a guitar G fit with at least one wound string 10, like that of FIGS. 1 and 2. The coating is depicted generally as reference numeral 16 and the central strand of the winding wire (or wrapping) 14 is shown as reference numeral 18.

A known acoustic string that is commonly viewed by musicians and skilled artisans as providing exemplary tonal characteristics includes a phosphor bronze winding around a core wire. During the typical manufacturing process, the phosphor bronze winding wire becomes work hardened when it is being drawn down to its final diameter and requires careful annealing. Wires are usually strand annealed in an oxygen free atmosphere. In the case of the disclosed coated wrap wire, the winding wire 14 is electro-plated with a layer or coating 16 of approximately 1-10% by weight relative to the weight of the winding wire 14 (i.e., inclusive of the weight of the plated metal). A particularly preferred embodiment of the winding wire 14 includes a plated metal coating 16 of between 3-5% by weight, and more preferably approximately 4% by weight, relative to the entire winding wire. Other exemplary embodiments of the string have been prepared with approximately 2% and approximately 8% by weight plated nickel relative to the entire winding wire.

Electroplating is a technical process that uses electric current to reduce dissolved metal cations so that they form a coherent metal coating on an electrode. The term is also used for electrical oxidation of anions onto a solid substrate.

Electroplating is primarily used to change the surface properties of an object, for example abrasion and wear resistance, corrosion protection, lubricity and/or aesthetic qualities. Processes of and techniques for electroplating, in and of themselves, are known.

The disclosed process of applying a coating 16 of nickel, tin or alloys thereof on a central strand 18 of steel or copper or an alloy thereof via an electroplating technique and the resulting string 10 provides a corrosion-resistant metal, tempered alloy wound string with substantially the same tonal characteristics of an uncoated string of the same metal. For example, an electroplated phosphor bronze wound string prepared by the above-described techniques has shown substantially the same or even better tonal characteristics compared to an uncoated phosphor bronze string. The resulting string, while grayish in color and differing visually relative to a normal phosphor bronze string, also retains its original tone significantly longer than uncoated counterparts. A nickel-plated, phosphor bronze acoustic fretted instrument string formed by the above-described electroplating process has been shown to provide the combined desirables features of a tone like an uncoated string and tonal longevity of a coated string. Other exemplary embodiments of the metal-plated string 10 have shown to provide the same combination of high initial tone quality and extended life. Examples of exemplary embodiments include strings with a nickel-plated steel winding (particularly suited for use with an electric guitar), strings with a nickel-plated brass winding, and similar strings with tin-plating in place of nickel.

In general, the disclosed embodiments may include a core wire 12 made from any kind of steel, and a winding wire 14 made of a central strand 18 of steel or a copper alloy with a thin coating 16 of nickel, nickel alloy, tin, or tin alloy. The core wire 12 can be traditional high-carbon steel or any other spring temper steel alloy such as managing steel. The base winding wire may be a bronze alloy, including for example, phosphor bronze, 80-20, 85-15, 90-10 or aluminum bronze. Alternatively, the winding wire may be made of a suitable brass composition. Yet another embodiment of the disclosed string, for use primarily with electric guitars, includes a plated wrapping with a central strand made of steel. A variety of nickel sources may be employed in suitable electroplating processes to achieve the plated winding or string. A particularly preferred embodiment of the disclosed wire includes a nickel coating from matte nickel sulfamate ($Ni(SO_3NH_2)_2$) via a suitable nickel sulfamate electroplating technique. Tin is a suitable substitute for nickel, as both may be plated and provide superior resistance to corrosion as compared to the bare copper-based alloy itself without dampening the initial string tone, like known polymer coatings.

Several exemplary coated wrapped music strings 10 with a winding 14 of nickel 16 electroplated on a central strand 18 of phosphor bronze were prepared with the electroplated nickel constituting approximately 2%, 4% and 8% by weight of the winding. These exemplary strings 10 have been observed to provide the high quality tonal characteristic of an uncoated phosphor bronze string of the same gauge when wound and used on the same instrument (in this case, the strings were used on an acoustic guitar). The exemplary coated wrapped strings 10 have also proven to maintain such crisp tonal characteristics significantly longer than an uncoated phosphor bronze string of the same gauge and frequency when used on the same acoustic instrument under similar conditions. Other embodiments of the disclosed string 10 exist wherein the coated wound string 10 is prepared by first winding the central strand 18 around the core wire 12, and then applying the coating 16 via electroplating.

Figure 4:
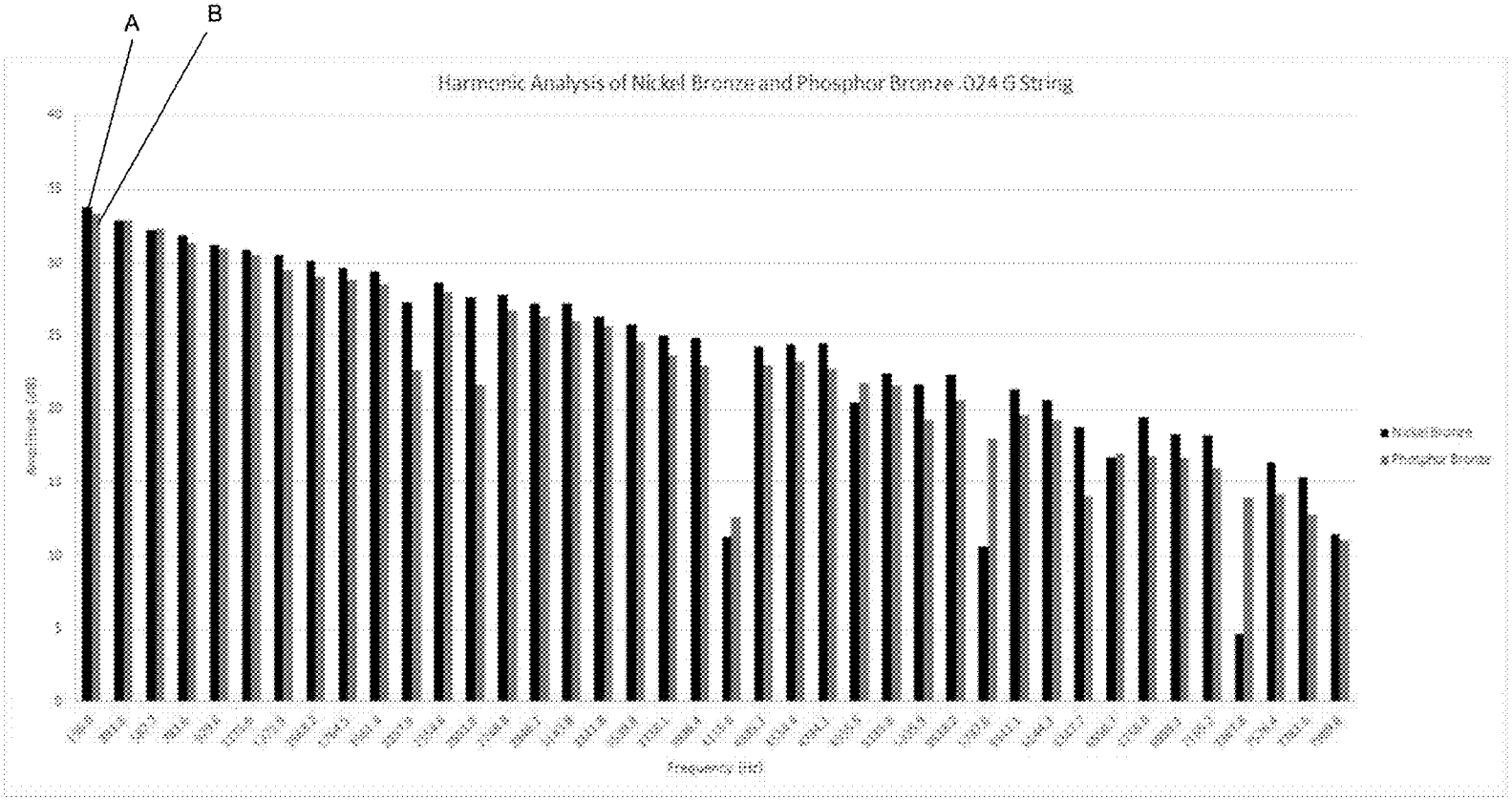
FIG. 4 displays comparative harmonic analysis data of an embodiment of the disclosed string and a commercial uncoated string.

FIG. 4 is a bar graph showing comparative harmonic data of the inventive nickel-plated bronze string (String A; left bars) and a known uncoated phosphor bronze string (String B; right bars). Both of the tested strings, String A and String B, were of a 0.024 gauge size. As shown, the inventive String A achieves comparable amplitude output to the known String B at all harmonic frequencies, and in most cases an even higher amplitude output. A higher amplitude output translates to a brighter or crisper sound preferable to musicians, as described herein.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A musical instrument string comprising
a core wire; and
a winding wire wrapped around the core wire,
wherein the winding wire comprises a central strand of metal alloy and a coating adhered to the central strand, the coating comprising at least one material selected from the group consisting of nickel, nickel alloy, tin, and tin alloy, and the coating constitutes approximately 2-8% by weight of the winding wire.

2. The music string of claim 1, wherein the metal alloy is a copper alloy.

3. The music string of claim 1, wherein the coating comprises nickel or tin.

4. The music string of claim 3, wherein the core wire is a tempered steel alloy.

5. The music string of claim 1, wherein the coating is electroplated nickel.

6. The music string of claim 5, wherein the electroplated nickel coating constitutes approximately 3-5% by weight of the winding wire.

7. The music string of claim 1, wherein the central strand of the winding wire is selected from the group consisting of copper, copper alloys and steel.

8. The music string of claim 7, wherein the coating is nickel or alloy thereof.

9. The music string of claim 1, wherein the winding on the wound string is a nickel coated copper alloy wire.

10. The music string of claim 9, wherein the nickel coating constitutes approximately 3-5% by weight of the winding wire.

11. The music string of claim 1, wherein the winding on the wound string is a nickel coated phosphor bronze wire.

12. A string for a musical instrument, comprising:
a core metal wire;
a central strand of a winding wire being a metal; and
a metal coating plated on the exterior of the central strand, the metal coating being nickel, a nickel alloy, tin or a tin alloy,
wherein the central strand is wrapped around the core metal wire and the coating constitutes approximately 5-8% by weight of the winding wire.

13. The string for a musical instrument of claim 12, wherein the central strand is a copper-based wire.

14. The string for a musical instrument of claim 12, wherein the central strand is wrapped around the core metal wire to define an uncoated wound string and the metal coating is plated on the uncoated wound string.

15. The string for a musical instrument of claim 12, wherein the central strand is plated with the metal coating to define a coated winding, and the coated winding is wrapped around the core metal wire.

16. A musical instrument string comprising:

a core metal wire; and a coated winding wire wrapped around the core wire, wherein the winding wire comprises a central strand comprising copper or steel and a coating of nickel, nickel alloy, tin or tin alloy adhered to the central strand via a process of electroplating, the coating on the winding wire constituting approximately 2-5% by weight of the winding wire.

17. The musical instrument string of claim 16, wherein the central strand is a bronze wire and the coating constitutes approximately 3-5% by weight of the winding wire.

18. The musical instrument string of claim 17, wherein the coating on the winding wire constitutes approximately 4% by weight of the winding wire.

19. The string for a musical instrument of claim 12, wherein coating constitutes approximately 8% by weight of the winding wire.

* * * * *